US010203640B1

(12) United States Patent
Morita

(10) Patent No.: US 10,203,640 B1
(45) Date of Patent: Feb. 12, 2019

(54) FIXING DEVICE AND IMAGE FORMING APPARATUS THEREWITH

(71) Applicant: KYOCERA Document Solutions Inc., Osaka (JP)

(72) Inventor: Takuro Morita, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 0 days.

(21) Appl. No.: 16/052,095

(22) Filed: Aug. 1, 2018

(30) Foreign Application Priority Data

Sep. 5, 2017 (JP) ..... 2017-170224

(51) Int. Cl.
*G03G 15/20* (2006.01)
*G03G 21/06* (2006.01)

(52) U.S. Cl.
CPC ..... *G03G 15/2064* (2013.01); *G03G 15/2028* (2013.01); *G03G 15/2053* (2013.01); *G03G 21/06* (2013.01)

(58) Field of Classification Search
CPC ..... G03G 15/2064; G03G 15/2028; G03G 15/2053; G03G 15/2032; G03G 21/06
See application file for complete search history.

(56) References Cited

U.S. PATENT DOCUMENTS 5,404,214 A * 4/1995 Yoshimoto ..... G03G 15/2064 219/216
2006/0067750 A1* 3/2006 Inoue ..... G03G 15/206 399/328
2015/0212466 A1* 7/2015 Fukunaga ..... G03G 15/2064 399/122
2016/0291514 A1* 10/2016 Fukunaga ..... G03G 15/2032
2017/0139373 A1* 5/2017 Honke ..... G03G 15/2039

FOREIGN PATENT DOCUMENTS

JP 2016-122036 A 7/2016

* cited by examiner

*Primary Examiner* — Sandra Brase
(74) *Attorney, Agent, or Firm* — Stein IP, LLC

(57) ABSTRACT

A fixing device has a heating member, a pressing member, a pressurizing mechanism pressing the pressing member against the heating member and a pressing force changing mechanism changing the pressing force of the pressing member against the heating member. The pressing force changing mechanism has an electrically conductive rotation shaft arranged opposite the surface of the pressing member across a predetermined interval, and a pressing force changing member provided at an end part of the rotation shaft and rotating about the rotation shaft to change the pressing force of the pressurizing mechanism. The rotation shaft has a static elimination sheet for eliminating electrical charge from the surface of the pressing member.

9 Claims, 4 Drawing Sheets

FIXING DEVICE AND IMAGE FORMING APPARATUS THEREWITH

INCORPORATION BY REFERENCE

This application is based upon and claims the benefit of priority from the corresponding Japanese Patent Application No. 2017-170224 filed on Sep. 5, 2017, the entire contents of which are incorporated herein by reference.

BACKGROUND

The present disclosure relates to a fixing device, and to an image forming apparatus provided with a fixing device. More particularly, the present disclosure relates to a fixing device having a static elimination sheet for eliminating electrical charge from the surface of a pressing member, and to an image forming apparatus provided with such a fixing device.

Conventionally, image forming apparatuses are provided with a fixing device for fixing a toner image transferred to a recording medium such as a sheet or the like from an image carrying member. As fixing devices, there are known those adopting a roller fixing method provided with a heating roller and a pressing roller rotating while in contact with each other, and those adopting a belt fixing method using an endless fixing belt as a heating member. For example, a fixing device of a roller fixing method heats and presses a toner image carried on a sheet in a nip portion between a fixing roller and a pressing roller kept in pressed contact with each other, and thereby fixes the toner image on the sheet.

In this fixing device, a pressing roller generally used is provided with an elastic layer of silicone rubber or the like on the circumference of a metal core and the circumference is further provided with a release layer of fluorine resin or the like. These elastic and release layers are electrically insulating, and thus the surface of the pressing roller can be charged to minus several thousand volts by friction with a recording medium. This can cause the recording medium to wind around the pressing roller and toner to attach to the fixing roller.

To avoid that, an image forming apparatus is proposed in which a fixing housing and a conveying guide of resin arranged around the pressing roller are provided with a static elimination sheet extending in the axial direction of the pressing roller, and in which the static elimination sheet is electrically grounded to the main body of the image forming apparatus via a plate spring.

SUMMARY

According to one aspect of the present disclosure, a fixing device includes a heating member, a pressing member, a pressurizing mechanism, and a pressing force changing mechanism. The heating member heats an unfixed toner image carried on a recording medium. The pressing member forms a fixing nip portion by making contact with the heating member. The pressurizing mechanism presses the pressing member against the heating member. The pressing force changing mechanism changes the pressing force of the pressing member against the heating member. The fixing device fixes the unfixed toner image to the recording medium passing through the fixing nip portion. The pressing force changing mechanism has an electrically conductive rotation shaft arranged parallel to the pressing member and opposite the surface of the pressing member across a predetermined interval, and a pressing force changing member provided at an end part of the rotation shaft and rotating about the rotation shaft to change the pressing force of the pressurizing mechanism. The rotation shaft is electrically grounded. The rotation shaft is provided with a static elimination sheet for eliminating electrical charge from the surface of the pressing member.

Further features and advantages of the present disclosure will become apparent from the description of embodiments given below.

DETAILED DESCRIPTION

Hereinafter, with reference to the accompanying drawings, an embodiment of the present disclosure will be described.

Figure 1:
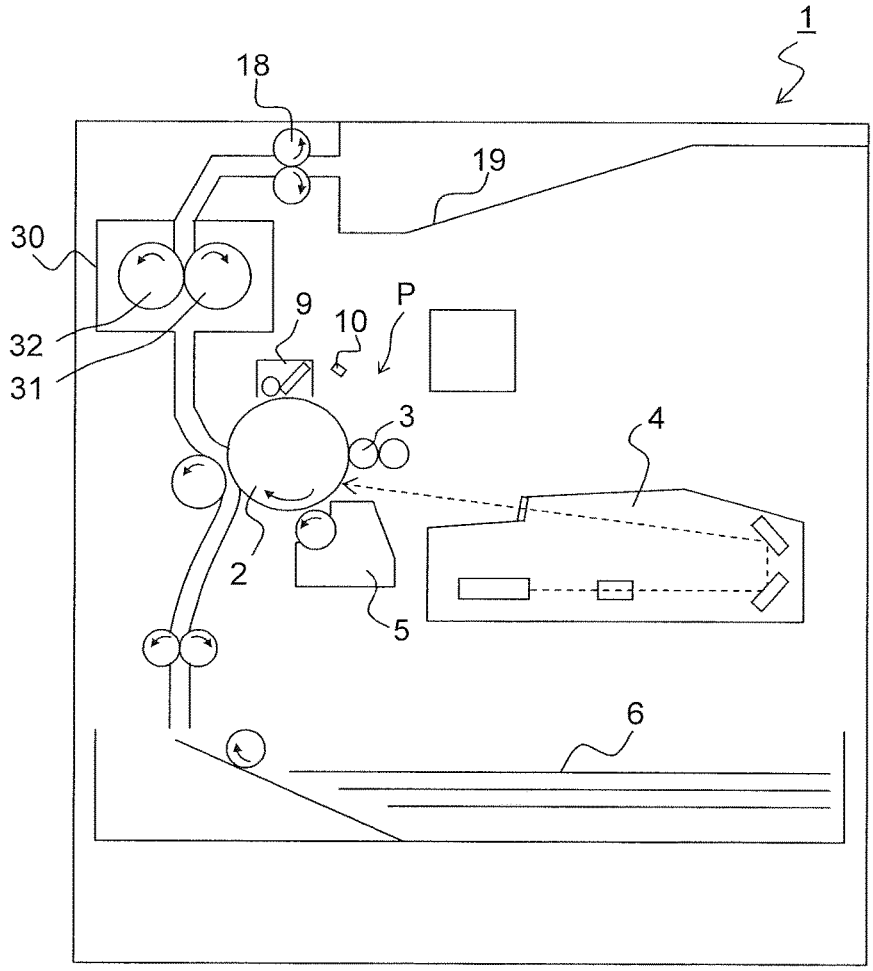
FIG. 1 is a sectional view schematically showing a structure of an image forming apparatus provided with a fixing device according to one embodiment of the present disclosure.

With reference to FIGS. 1 to 5, an image forming apparatus 1 according to one embodiment of the present disclosure will be described. The right side in FIG. 1 corresponds to the front side of the image forming apparatus 1. As shown in FIG. 1, inside the image forming apparatus 1 (here, a monochrome printer), an image forming section P is arranged. The image forming section P forms a predetermined image through the steps of charging, exposure, developing, and transferring.

In the image forming section P, a photosensitive drum (image carrying member) 2 carrying a visible image (toner image) is arranged. The toner image formed on the photosensitive drum 2 is transferred to a recording medium 6 such as regular paper, an envelope, or thick paper, and is then fixed to the recording medium 6 in a fixing device 30. Then, the recording medium 6 is discharged from an apparatus main body. While the photosensitive drum 2 is rotated by an unillustrated drum driving motor in the clockwise direction in FIG. 1, the image forming process is performed with respect to the photosensitive drum 2.

Around and in front of (on the right side in FIG. 1) the photosensitive drum 2 which is rotatably arranged, there is provided a charging roller 3 for electrostatically charging the photosensitive drum 2, an exposing unit 4 for exposing the photosensitive drum 2 to light carrying image information, a developing unit 5 for forming a toner image on the photosensitive drum 2, a cleaning device 9 for collecting developer (toner) remaining on the photosensitive drum 2, and a static eliminator 10 for removing an electrostatic latent image.

The recording medium 6 having a toner image transferred to it by the photosensitive drum 2 is conveyed to the fixing device 30. The recording medium 6 conveyed to the fixing device 30 is heated and pressed by a fixing roller 31 and a pressing roller 32 described later, so that the toner image is fixed to the surface of the recording medium 6, and thereby a predetermined image is formed. The recording medium 6 having passed through the fixing device 30 is curled. Thus, on the downstream side of the fixing device 30 in the recording medium conveying direction, a decurling device 60 (see FIG. 2) is arranged so as to correct a curl in the recording medium 6. The recording medium 6 having passed through the decurling device 60 is discharged onto a discharged tray 19 by a discharge roller pair 18.

Figure 2:
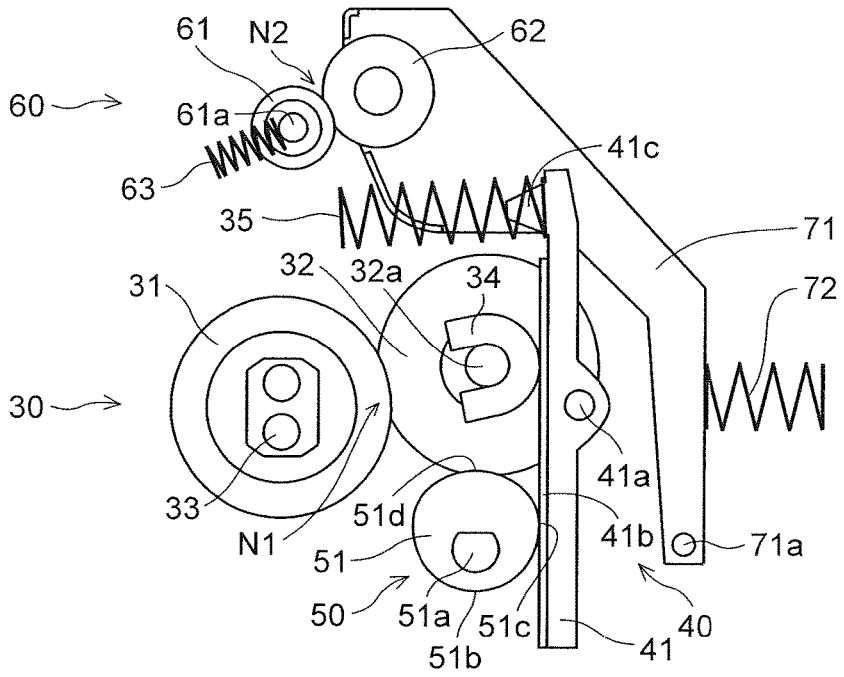
FIG. 2 is a diagram showing a structure of and around the fixing device according to the one embodiment of the present disclosure, showing a state where an image is formed on regular paper (a normal pressure state)
Figure 4:
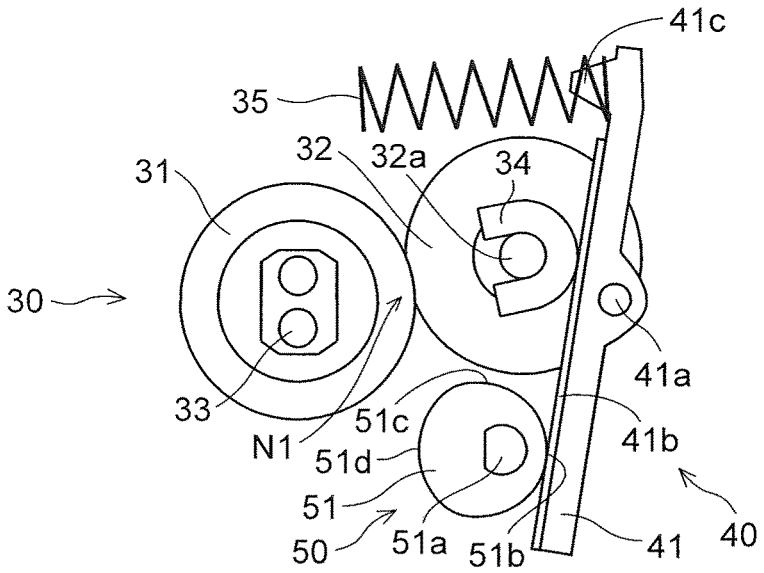
FIG. 4 is a diagram showing a structure of the fixing device according to the one embodiment of the present disclosure, showing a state where an image is formed on an envelope (a reduced pressure state)
Figure 5:
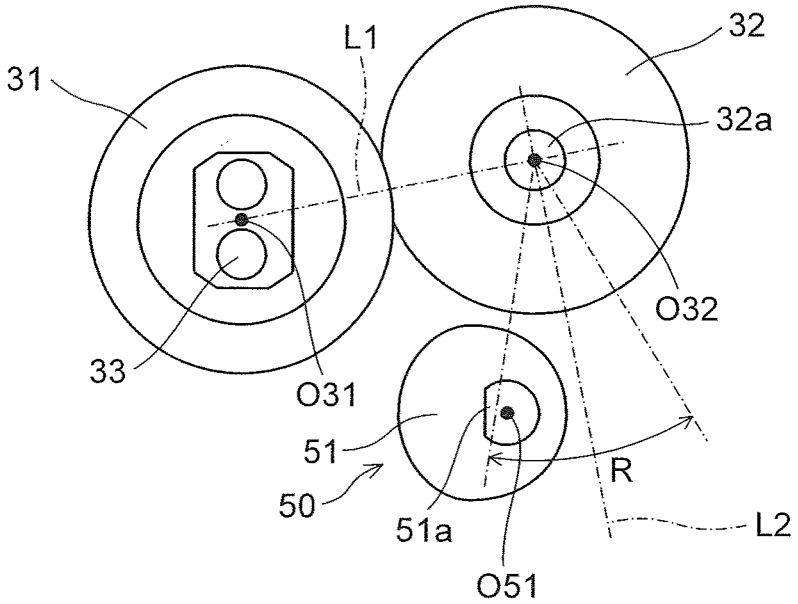
FIG. 5 is a diagram showing a arrangement position of a rotation shaft of an eccentric cam in the fixing device according to the one embodiment of the present disclosure.

As shown in FIG. 2, the fixing device 30 includes a fixing roller 31 which is a heating member heating an unfixed toner image carried on the recording medium 6, a pressing roller 32 which is a pressing member rotating while in contact with the fixing roller 31 under a predetermined pressure, a pressurizing mechanism 40 pressing the pressing roller 32 against the fixing roller 31, and a pressing force changing mechanism 50 changing the pressing force of the pressing roller 32 against the fixing roller 31. The fixing device 30 fixes an unfixed toner image to the recording medium 6 passing through a fixing nip portion N1 formed between the fixing roller 31 and the pressing roller 32. A fixing housing (unillustrated) housing the fixing roller 31, the pressing roller 32, the pressurizing mechanism 40, and the pressing force changing mechanism 50 and a conveying guide (unillustrated) guiding the recording medium 6 are formed of resin. FIG. 2, FIG. 4, and FIG. 5 are views from behind what is shown in FIG. 1, and accordingly, in FIG. 2, FIG. 4, and FIG. 5, the arrangement of components is reversed left to right as compared with that in FIG. 1.

As the fixing roller 31, what is called a hard roller is used which is a cylindrical metal core made of metal with excellent thermal conductivity such as aluminum or iron coated with a coating or a tube of a fluorine resin. Inside the metal core of the fixing roller 31, a halogen heater 33 is provided as a heat source, so that the surface of the fixing roller 31 is kept at a predetermined temperature. Used as the pressing roller 32 is a cylindrical base made of synthetic resin, metal, or other material having formed on it an elastic layer of silicone rubber or the like. The elastic layer is covered on its surface with a release layer with excellent mold releasability such as fluorine resin or the like.

Figure 3:
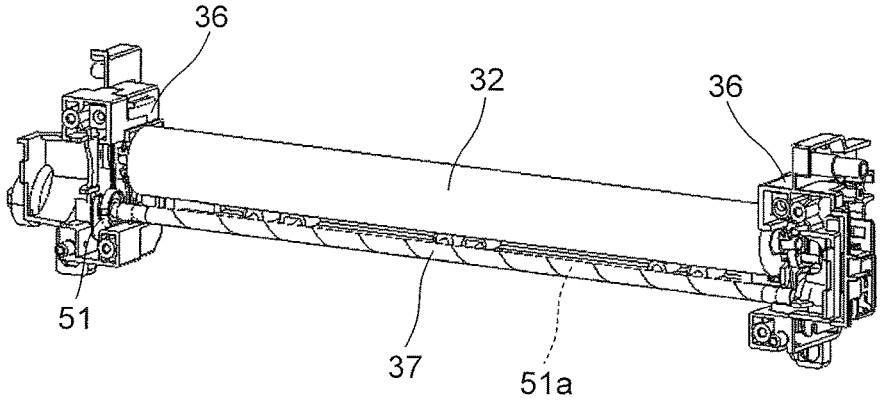
FIG. 3 is a perspective view showing a structure of and around a pressing roller in the fixing device according to one embodiment of the present disclosure.

The fixing roller 31 is rotatably held on a fixing frame (unillustrated). The pressing roller 32 has both end parts of a rotation shaft 32*a* rotatably held on a pair of bearing members 34. As shown in FIG. 3, the bearing members 34 are supported on guide members 36 which are arranged at both sides of the fixing roller 31 in its longitudinal direction, and are configured to be reciprocatable in approaching and receding directions with respect to the fixing roller 31.

As shown in FIG. 2, the pressurizing mechanism 40 includes a pressurizing lever (pressurizing member) 41 made of sheet metal pressing the pressing roller 32 against the fixing roller 31, and a pressing force changing mechanism 50. The pressurizing lever 41 is provided approximately symmetrically at either side of the fixing device 30 in its longitudinal direction. The pressurizing lever 41 is pivotable about a swing shaft 41*a* provided in a central part of it in its longitudinal direction (an up-down direction). On the bearing member 34-side of the pressurizing lever 41 (on the left side in FIG. 2), a contact piece 41*b* is formed in a folded state which makes contact with the bearing member 34 and with an eccentric cam (pressing force changing member) 51, which will be described later, of the pressing force changing mechanism 50. In a top end part of the pressurizing lever 41, a protrusion 41*c* is formed to which a biasing member 35 comprising a compression spring and provided in the fixing device 30 is fitted. The pressurizing lever 41 is biased by the biasing member 35 in the clockwise direction (the direction in which the pressing roller 32 moves away from the fixing roller 31) in FIG. 2. The biasing member 35 is an example of a "biasing member" according to the present disclosure.

The pressing force changing mechanism 50 includes an eccentric cam 51 in which the distance from the rotation center to the circumferential face varies in the circumferential direction, and a driving source (unillustrated) which rotates a rotation shaft 51*a* of the eccentric cam 51. The eccentric cam 51 is provided approximately symmetrically at either side of the fixing device 30 in its longitudinal direction, and is fixed at both end parts of one rotation shaft 51*a*. The eccentric cam 51 has a small-diameter part 51*b* in which the distance from the rotation center to the circumferential face is shortest, a maximum-diameter part 51*d* in which the distance from the rotation center to the circumferential face is longest, and a large-diameter part 51*c* in which the distance from the rotation center to the circumferential face is longer than that in the small-diameter part 51*b* but shorter than that in the maximum-diameter part 51*d*.

When the small-diameter part 51*b* of the eccentric cam 51 is in contact with the contact piece 41*b* of the pressurizing lever 41 (the state in FIG. 4), the pressurizing lever 41 is in a state rotated furthest about the swing shaft 41*a* in the clockwise direction (the direction in which the pressing roller 32 moves away from the fixing roller 31) in FIG. 4, that is, in a state where the pressing force of the pressing roller 32 against the fixing roller 31 is the smallest (a reduced pressure state).

On the other hand, when, as shown in FIG. 2, the eccentric cam 51 rotates about the rotation shaft 51*a* until the large-diameter part 51*c* makes contact with the contact piece 41*b* of the pressurizing lever 41, then the pressing force of the pressing roller 32 against the fixing roller 31 increases. That is, the eccentric cam 51 presses the pressurizing lever 41 against the biasing force of the biasing member 35 in the counter-clockwise direction (the predetermined direction) in FIG. 2. In this embodiment, a state (in a state in FIG. 2) where the large-diameter part 51*c* is in contact with the contact piece 41*b* is a normal pressure state which is set when regular paper is passed, and a state (in a state in FIG. 4) where the small-diameter part 51*b* is in contact with the contact piece 41*b* is a reduced pressure state which is set when an envelope or thick paper is passed.

When the maximum-diameter part 51*d* is put into contact with the contact piece 41*b*, the pressing force of the pressing roller 32 against the fixing roller 31 increases further.

The rotation shaft 51*a* of the eccentric cam 51 is arranged parallel to the pressing roller 32, and is arranged opposite the surface of the pressing roller 32 across a predetermined interval (here, about 5 mm). The rotation shaft 51*a* is, in both end parts, rotatably pivoted on the guide members 36 (see FIG. 3). The rotation shaft 51*a* is made of metal, is electrically conductive, and is electrically grounded to a frame (unillustrated) of the main body of the image forming apparatus 1 via grounded sheet metal (unillustrated) provided on the guide members 36. The grounded sheet metal permits also members other than the rotation shaft 51*a* to be electrically grounded to the frame of the main body of the image forming apparatus 1.

As shown in FIG. 5, the rotation shaft 51*a* is arranged near a line L2 which passes through the center O32 of the pressing roller 32 and which is perpendicular to a line L1 connecting between the center O31 of the fixing roller 31 and the center O32 of the pressing roller 32. The center O51 of the rotation shaft 51*a* is arranged within an angle range R of 20 degrees or less about the center O32 of the pressing roller 32 with respect to the line L2.

As shown in FIG. 3, to the rotation shaft 51*a*, a static elimination sheet 37 for eliminating electrical charge from the surface of the pressing roller 32 is fixed in a helically wound state. The static elimination sheet 37 is stuck to the surface of the rotation shaft 51*a* with conductive double-sided tape or the like.

The static elimination sheet 37 is an electrically conductive sheet-form member, such as a sheet of nonwoven, woven, or knit fabric coated with conductive polymer, or a sheet mixed with metal fiber or carbon fiber.

As shown in FIG. 2, the decurling device 60 includes a pressing roller 61, a correcting roller 62 which forms a correcting nip portion N2 by making contact with the pressing roller 61, a holding member 71 made of sheet metal or resin which rotatably holds the correcting roller 62 and which pressing the correcting roller 62 against the pressing roller 61, and a biasing member 72 comprising a compression spring which biases the holding member 71. The decurling device 60 corrects a curl in the recording medium 6 passing through the correcting nip portion N2. The holding member 71 and the biasing member 72 are provided approximately symmetrically at either side of the decurling device 60 in its longitudinal direction.

The pressing roller 61 has both end parts of a rotation shaft 61*a* rotatably held on a pair of bearing members (unillustrated), and is biased by a pair of a biasing member 63 comprising a compression spring provided in the decurling device 60 in a direction approaching the correcting roller 62. The biasing member 63 is arranged at either side of the pressing roller 61.

The holding member 71 is configured to be swingable, about a swinging shaft 71*a* provided in a lower end part of it, in such directions as to make the correcting roller 62 approach and recede from the pressing roller 61.

The holding member 71 is biased by the biasing member 72 in the leftward direction in FIG. 2 (the direction in which the correcting roller 62 approaches the pressing roller 61).

In this image forming apparatus 1, when an image is formed on regular paper, as shown in FIG. 2, the large-diameter part 51*c* of the eccentric cam 51 is put into contact with the contact piece 41*b* of the pressurizing lever 41, and the pressing force of the pressing roller 32 against the fixing roller 31 (the fixing nip pressure at the fixing nip portion N1) has a predetermined value (a predetermined fixing nip pressure).

On the other hand, for example, when an image is formed on an envelope, to suppress winkles on the envelope, as shown in FIG. 4, the small-diameter part 51*b* of the eccentric cam 51 is put into contact with the contact piece 41*b* of the pressurizing lever 41, and the pressing force of the pressing roller 32 against the fixing roller 31 (the fixing nip pressure at the fixing nip portion N1) is reduced.

Here, the pressing roller 32 moves a small distance (about 1 to 2 mm) approximately linearly in the direction (the rightward direction in FIG. 4) away from the fixing roller 31 within a range in which it does not move off the fixing roller 31. Thus, the pressing force of the pressing roller 32 against the fixing roller 31 (the fixing nip pressure at the fixing nip portion N1) is reduced.

In this embodiment, as described above, the rotation shaft 51*a* which is arranged opposite the surface of the pressing roller 32 across a predetermined interval is provided with the static elimination sheet 37 for eliminating electrical charge from the surface of the pressing roller 32. Thus, it is possible to suppress charging of the pressing roller 32, and thus, it is also possible to suppress winding of the recording medium 6 around the pressing roller 32 and attachment of toner to the fixing roller 31.

Providing the rotation shaft 51*a* with the static elimination sheet 37 permits the static elimination sheet 37 to be electrically grounded via the rotation shaft 51*a*. Thus, it is not necessary to additionally provide a plate spring or the like as in conventional image forming apparatuses, and thus it is not necessary to increase the number of components and to secure a space for arrangement of a plate spring. It is possible to reduce manufacturing cost and weight compared with when a fixing housing and a conveying guide (neither is shown) are made of metal and a static elimination sheet 37 is arranged on them.

As described above, in the fixing device 30 in which the pressing force of the pressing roller 32 against the fixing roller 31 can be changed, it is possible to eliminate electrical charge from the surface of the pressing roller 32 with a simple structure.

As described above, the static elimination sheet 37 is helically wound around the rotation shaft 51*a*. Thus, it is possible to effectively suppress the peeling off of the static elimination sheet 37 from the rotation shaft 51*a*. The temperature of the fixing device 30 becomes high, and this causes the static elimination sheet 37 to peel off easily. Thus, it is particularly effective that the static elimination sheet 37 is helically wound around the rotation shaft 51*a* to suppress the peeling off of the static elimination sheet 37 from the rotation shaft 51*a*.

As described above, the rotation shaft 51*a* is arranged near a line L2 which passes through the center O32 of the pressing roller 32 and which is perpendicular to a line L1 connecting between the center O31 of the fixing roller 31 and the center O32 of the pressing roller 32. Thus, even when the pressing roller 32 is moved a small distance to the right side so as to be in a reduced pressure state, the distance from the surface of the pressing roller 32 to the static elimination sheet 37 hardly changes, and thus it is possible to easily suppress complicating the elimination of electrical charge from the surface electrical charge of the pressing roller 32.

As described above, the center O51 of the rotation shaft 51*a* is arranged within an angle range R of 20 degrees or less about the center O32 of the pressing roller 32 with respect to the line L2. Thus, even when the pressing roller 32 is moved a small distance to the right side so as to be in a reduced pressure state, it is possible to sufficiently suppress complicating the elimination of electrical charge from the surface electrical charge of the pressing roller 32.

As described above, the pressurizing mechanism 40 is pivotable about the swing shaft 41*a* and has the pressurizing lever 41 pressing the pressing roller 32 against the fixing roller 31. The eccentric cam 51 presses the pressurizing lever 41 in the predetermined direction. Thus, by rotating the eccentric cam 51 about the rotation shaft 51*a*, it is possible to change the pressing force of the pressurizing mechanism 40 easily.

As described above, the fixing device 30 has the biasing member 35 biasing the pressurizing lever 41 in the direction opposite to the direction in which the eccentric cam 51 presses the pressing lever 41. Thus, it is possible to easily pivot the pressurizing lever 41 in the clockwise direction or the counter-clockwise direction in coordination with the rotating of the eccentric cam 51.

The embodiments disclosed herein should be understood to be in every respect illustrative and not restrictive. The scope of the present disclosure is not defined by the description of embodiments given above but by the appended claims, and encompasses any modifications made in the sense and scope equivalent to those of the claims.

For example, although the embodiments described above deal with an example where the present disclosure is applied to a monochrome printer, this is not meant to limit the present disclosure. Needless to say, the present disclosure find applications in a variety of image forming apparatuses provided with a fixing device, such as color printers, monochrome copiers, digital multifunction peripherals and facsimile machines.

Figure 6:
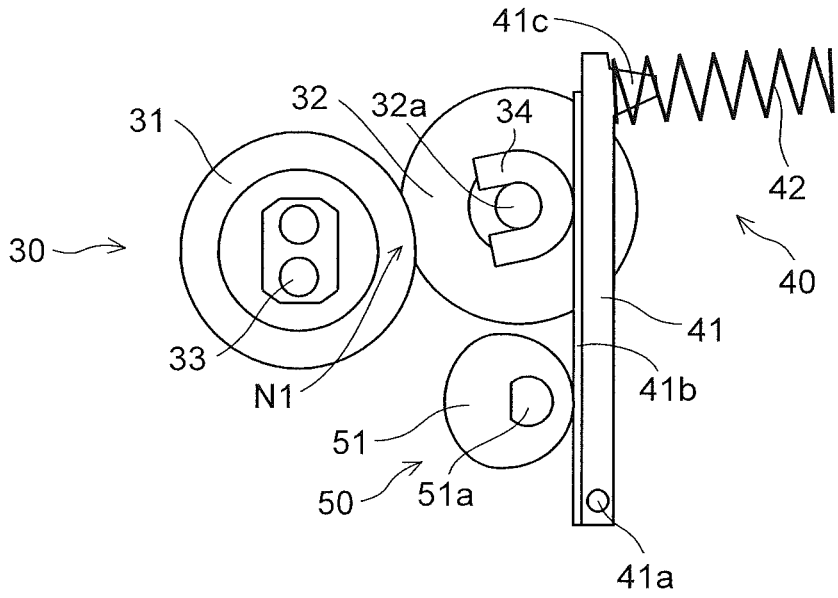
FIG. 6 is a diagram showing a structure of and around a pressing roller in a fixing device according to a first modified example of the present disclosure.

Although the embodiments described above deal with an example where the pressurizing mechanism 40 serves also as the pressing force changing mechanism 50, this is not meant to limit the present disclosure. The pressurizing mechanism 40 may not necessarily serve also as the pressing force changing mechanism 50. For example, it may be configured like the fixing device 30 of a first modified example according to the present disclosure shown in FIG. 6. That is, the pressurizing mechanism 40 may comprise a pressurizing lever 41 rotating about a swing shaft 41*a* provided in a lower end part of it and a biasing member (a second biasing member) 42 biasing the pressurizing lever 41 in the counter-clockwise direction in FIG. 6 (the direction in which the pressing roller 32 approaches the fixing roller 31) so that the pressurizing lever 41 pivots in the clockwise direction in FIG. 6 (the direction in which the pressing roller 32 moves away from the fixing roller 31) as a result of the eccentric cam 51 pressing the pressurizing lever 41.

Although the embodiments described above deal with an example where the eccentric cam 51 rotating to change the pressing force of the pressurizing mechanism 40 is provided and the rotation shaft 51*a* of the eccentric cam 51 is provided with the static elimination sheet 37, this is not meant to limit the present disclosure. For example, the rotation shaft 51*a* may be provided with a gear (pressing force changing member) so that, as the gear rotates about the rotation shaft 51*a*, the pressurizing lever pivots via another member (such as a gear train). Then, the rotation shaft 51*a* of the gear may be provided with the static elimination sheet 37.

Figure 7:
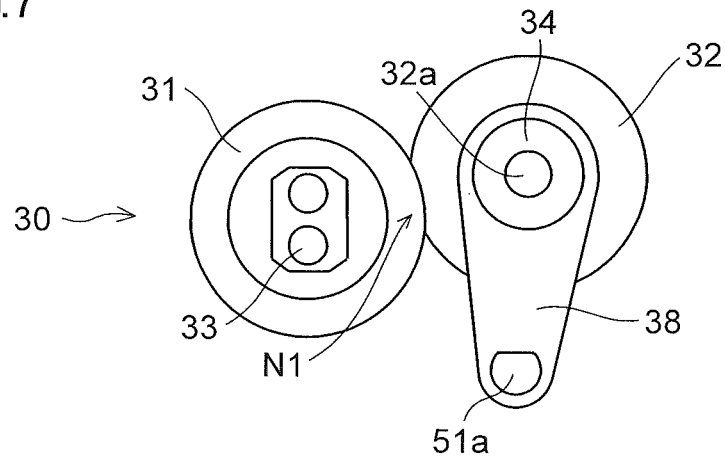
FIG. 7 is a diagram showing a structure of and around a pressing roller in a fixing device according to a second modified example of the present disclosure.

Although the embodiments described above deal with an example where the pressing roller 32 moves approximately linearly in the direction away from the fixing roller 31, this is not meant to limit the present disclosure. The pressing roller 32 may be configured to move about a predetermined swinging shaft in the direction away from the fixing roller 31. In that case, for example, it may be configured like a fixing device of a second modified example according to the present disclosure shown in FIG. 7. That is, a swinging member 38 swinging about a rotation shaft 51*a* is provided and a pressing roller 32 may be rotatably arranged on the swinging member 38. With this structure, even when the pressing roller 32 swings about the rotation shaft 51*a*, the distance from the surface of the pressing roller 32 to the static elimination sheet 37 does not change (be stable), thus it is possible to reliably prevent complicating the elimination of electrical charge from the surface of the pressing roller 32. In FIG. 7, the eccentric cam 51 and the pressurizing mechanism 40 are omitted from illustration.

The technical scope of the present disclosure includes any configuration obtained by appropriately combining the configurations of the embodiments and of the modified examples described above.

What is claimed is:

1. A fixing device comprising:

a heating member heating an unfixed toner image carried on a recording medium;

a pressing member forming a fixing nip portion by making contact with the heating member;

a pressurizing mechanism pressing the pressing member against the heating member; and a pressing force changing mechanism changing a pressing force of the pressing member against the heating member, wherein the fixing device fixes the unfixed toner image to the recording medium passing through the fixing nip portion, the pressing force changing mechanism has:

an electrically conductive rotation shaft arranged parallel to the pressing member and opposite a surface of the pressing member across a predetermined interval; and a pressing force changing member provided at an end part of the rotation shaft and rotating about the rotation shaft to change the pressing force by the pressurizing mechanism, the rotation shaft is electrically grounded, and the rotation shaft is provided with a static elimination sheet for eliminating electrical charge from the surface of the pressing member.

2. The fixing device according to claim 1, wherein the static elimination sheet is helically wound around the rotation shaft.

3. The fixing device according to claim 1, wherein the rotation shaft is arranged near a line which passes through a center of the pressing member and which is perpendicular to a line connecting between a center of a heating member and the center of the pressing member.

4. The fixing device according to claim 3, wherein a center of the rotation shaft is arranged within an angle range of 20 degrees or less about the center of the pressing member with respect to the line which passes through the center of the pressing member.

5. The fixing device according to claim 1, wherein the pressurizing mechanism has a pressurizing member which is pivotable about a swing shaft and which presses the pressing member against the heating member, and the pressing force changing member is an eccentric cam pressing the pressurizing member in a predetermined direction.

6. The fixing device according to claim 5, wherein the fixing device has a biasing member biasing the pressurizing member in a direction opposite to a direction in which the eccentric cam presses the pressurizing member.

7. The fixing device according to claim 5, wherein the eccentric cam serves also as the pressuring mechanism.

8. The fixing device according to claim 1, wherein the pressing member is rotatably supported on a swinging member swinging about the rotation shaft.

9. An image forming apparatus comprising;

the fixing device according to claim 1; and an image forming section.

* * * * *